United States Patent [19]

Iname

[11] Patent Number: 5,026,578

[45] Date of Patent: Jun. 25, 1991

[54] ARTIFICIAL-FLOWER-FORMING RIBBON

[75] Inventor: Morito Iname, Aichi, Japan

[73] Assignee: Kubushiki Kaisha Aoyama, Aichi, Japan

[21] Appl. No.: 546,865

[22] Filed: Jul. 2, 1990

[30] Foreign Application Priority Data

Nov. 9, 1989 [JP] Japan ..... 1-290114
Jan. 8, 1990 [JP] Japan ..... 2-472

[51] Int. Cl.[5] ..... A41G 1/00; D04D 7/10

[52] U.S. Cl. ..... 428/4; 156/70; 223/46; 428/26; 428/101; 428/192

[58] Field of Search ..... 156/70; 223/46; 428/4, 428/5, 24, 26, 101, 192

[56] References Cited

U.S. PATENT DOCUMENTS

| | | | |
|---|---|---|---|
| 3,637,455 | 1/1972 | Pearson et al. | 428/4 |
| 4,476,168 | 10/1984 | Aoyama | 428/4 |
| 4,515,837 | 5/1985 | Cheng | 428/4 |
| 4,585,676 | 4/1986 | De Smet et al. | 428/5 |
| 4,684,552 | 8/1987 | La Brosse et al. | 428/4 |
| 4,812,338 | 3/1989 | Masui | 428/4 |

FOREIGN PATENT DOCUMENTS

| | | |
|---|---|---|
| 50-3076 | 1/1975 | Japan . |
| 60-14726 | 5/1985 | Japan . |

*Primary Examiner*—Henry F. Epstein
*Attorney, Agent, or Firm*—Graybeal Jackson Richardson & Haley

[57] ABSTRACT

An artificial-flower-forming ribbon comprises a pair of strips overlapping each other, and at least one string placed between and along both strips. Both strips are joined together at a plurality of joint portions placed at opposite sides of the string and also on a plurality of lines spaced apart from each other in the longitudinal direction of both strings. The string is joined at its one end to one ends of both strips. A pair of adjoining lines are parallel to two equilateral sides of an isosceles triangle where a segment parallel to a longitudinal center line of both strips is defined as the base. Both strips have a pair of notches provided at opposite sides of each line to be respectively open to opposite side edges of both strips, and substantially confronting each other in the transverse direction of both strips.

12 Claims, 4 Drawing Sheets

ARTIFICIAL-FLOWER-FORMING RIBBON

BACKGROUND OF THE INVENTION

1. Field of the Invention

This invention relates to a ribbon and, more particularly, to a ribbon for forming an artificial flower to be attached to an article for decoration.

2. Description of the Prior Art

Conventionally, as disclosed in Japanese Utility Model Publication (KOKOKU) No. 60-14726, an artificial-flower-forming ribbon comprising a pair of strips overlapping each other and at least one string placed between and along both strips and joined at its one end to one ends of both strips is well known.

In such conventional artificial-flower-forming ribbon, both strips have a plurality of joint portions placed at opposite sides of the string and also on a plurality of lines spaced apart from each other in the longitudinal direction of both strips. A pair of adjoining lines extend parallel to two equilateral sides of an isosceles triangle having the base placed on a line parallel to a longitudinal center line of both strips, and are inclined to be alternately reverse.

According to such conventional artificial-flower-forming ribbon, when the string is longitudinally moved relative to both strips, a pair of strip portions defined between a pair of adjoining lines are curved to form a pair of loops. Since a pair of adjoining lines are inclined to be alternately reverse, one pair of loops are produced at positions reverse to another pair of loops adjoining to the one pair of loops. The inclination angle defined by each pair of loops is equal to an angle defined by two adjoining lines.

With the relative movements of the string to both strips, a plurality of pairs of loops are so formed as to be piled up one another at each two positions in inverse relation to each other, whereby an artificial flower having petals defined by these loops is formed by such conventional artificial-flower-forming ribbon.

However, the artificial flower formed by such conventional artificial-flower-forming ribbon as noted above looks unnatural, since a plurality of pairs of loops at the respective positions confront one another in the longitudinal direction of the string. In order to avoid the unnaturalness and bring this artificial flower to have an arrangement of petals close to a natural flower, a plurality of pairs of loops have been twisted around the longitudinal center line of the string, after the formation of the artificial flower, to thereby cause a plurality of pairs of loops to confront one another only at one portions thereof. However, the artificial flower obtained in such manner involves problems in that a plurality of pairs of loops subjected to torsion are returned to its original state, that is, these loops tend to become untwisted to return to a condition to confront one another in the longitudinal direction of the string due to a contact of the artificial flower with another matter, a vibration exerted on the artificial flower, a lapse of time or the like.

SUMMARY OF THE INVENTION

An object of the present invention is to provide an artificial-flower-forming ribbon capable of forming an artificial flower, which is free from untwisting of a plurality of pairs of loops due to a contact thereof with another matter, an action of an external force, a lapse of time or the like in order to dissolve such conventional drawbacks.

Another object of the present invention is to provide an artificial-flower-forming ribbon, which permits torsion to be given a plurality of pairs of loops during the formation of an artificial flower.

An artificial-flower-forming ribbon according to the present invention comprises a pair of strips overlapping each other, and at least one string placed between and along both strips, both strips being joined together at a plurality of joint portions placed at opposite sides of the string and also on a plurality of lines spaced apart from each other in the longitudinal direction of both strips, the string being joined at its one end to one ends of both strips, and a pair of adjoining lines being parallel to two equilateral sides of an isosceles triangle where a segment parallel to a longitudinal center line of both strips is defined as the base, wherein both strips have a pair of notches provided at opposite sides of each line to be respectively open to opposite side edges of both strips, and substantially confronting each other in the transverse direction of both strips.

According to the present invention, a pair of strip portions are defined between two pairs of adjoining notches. Each pair of strip portions includes a pair of joint portions longitudinally placed at opposite ends of both strips. A pair of joint portions in each pair of strip portions are placed at one side of the string, and a pair of strip portions in another pair of strip portions adjoining to the one pair of strip portions are placed at the other side of the string.

When the string is moved relative to both strips so as to form the artificial flower, two pairs of adjoining strip portions are deformed into two pairs of loops, which are positioned to be alternately reverse. Further, the joint portions themselves of one of two pairs of adjoining loops in the extending direction of the string extend in the direction substantially perpendicular to the string, and these two pairs of adjoining loops partially overlap each other. As a result, one of two pairs of adjoining loops in the longitudinal direction of the string are forced to be angularly displaced to the other loop pair around the longitudinal center line of the string. Accordingly, two pairs of adjoining loops in the longitudinal direction of the string confront each other at only one of the portions thereof without being aligned with each other. Thus, the artificial flower maintains its natural form without a cancellation of a partially confronting condition of these pairs of loops due to a contact of the artificial flower with another matter, an action of an external force on the artificial flower such as vibration, a lapse of time or the like.

The notch selectively takes a V-like shape, a circular-arc shape or the like, for example, and one side of the V-like notch is set to be parallel to the above-mentioned line.

Each joint portion of both strips takes an elongated plane shape or a dot-like shape, for example. The joint portion of the elongated plane shape is permitted to come to an end at each edge portion of the strip.

Both strips can be joined together by means of thermal welding, adhesion with an adhesive, stitching with thread or the like in consideration of the material of both strips and the cost of manufacture or the like.

Further, the mutual distance between each pair of lines is set to increase gradually from one ends to the other ends of both strips. By so doing, each pair of partially overlapping loops are different from each other in length, whereby an artificial flower which looks like a rose can be obtained.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1:
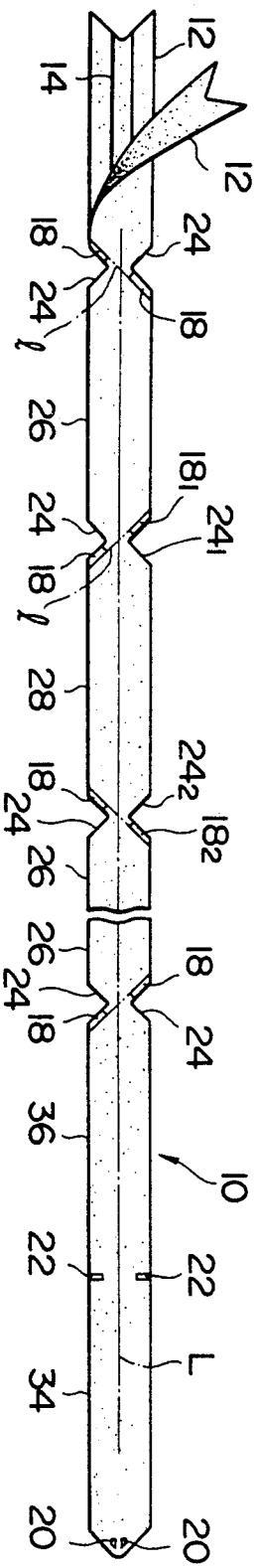
FIG. 1 is a plan view showing an embodiment of an artificial-flower-forming ribbon according to the present invention.
Figure 4:
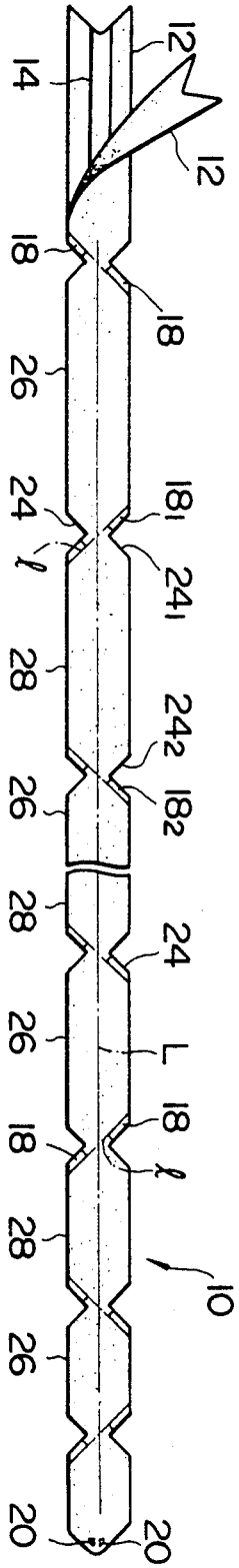
FIG. 4 is a plan view showing another embodiment of the artificial-flower-forming ribbon according to the present invention.

As shown in FIGS. 1 and 4, an artificial-flower-forming ribbon 10 of the present invention comprises a pair of overlapped strips 12 and a pair of overlapped strings 14 placed between and along both strips 12. Each strip 12 is wider than each string 14. Both strings 14 are placed in the widthwise (transversely) direction in the substantial middle of both strips 12.

Each strip 12 and each string 14 are made of cloth of natural fiber, or synthetic fiber such as nylon fiber and polyester fiber or chemical fiber, such as acetate fiber, or a tape of polypropylene or vinyl or the like. Not only may a pair of strings 14 be used, but also a single string or three or more strings may be used. When two or more strings are used, these strings are available for winding means for fixing an artificial flower 16 (See FIGS. 3 and 5) formed by the ribbon 10 around a gift or a package thereof (not shown).

Both strips 12 are joined together at opposite sides of both strings 14. Also, both strings 14 are joined at one of their ends (right end in the drawing) to one ends (right end in the drawing) of both strips 12. Thus, both strings 14 can be moved relative to both strips 12 in the longitudinal direction of both strings 14. With the relative movements of both strings 14 to both strips 12, the artificial flower 16 is formed. Reference numeral 18 designates each of a plurality of portions where both strips 12 are joined together. Also, reference numeral 20 designates each of two portions where both strings 14 are joined at their one ends to one ends of both strips 12.

Each joint portion 18 is placed on the corresponding one of a plurality of lines l spaced apart from each other in the longitudinal direction of both strips 12. In the illustrated embodiment, two joint portions 18 are placed on one line l, and besides, at the opposite sides of both strings 14. A plurality of lines l consist of a plurality of pairs of lines, each pair of which consists of two lines parallel to two equilateral sides of an isosceles triangle (imaginary isosceles triangle) where a line segment parallel to the longitudinal center line L of both strips 12 is defined as a base. Thus, a pair of adjoining lines l in the longitudinal direction of both strips 12 are inclined to be alternately reverse.

In the embodiment shown in FIG. 1, both strips 12 are further joined together at two joint portions 22 which are not placed on any line ( or between any one pair of lines l. These joint portions 22 are placed at the opposite sides of both strings 14 in positions slightly distant from the one ends of both strips 12 toward the other ends with respect to the longitudinal direction of both strips 12, and besides, on a line (not shown) perpendicular to the longitudinal center line L.

A plurality of pairs of notches 24 are provided in opposite edge portions of both strips 12. Each notch 24 takes a V-like shape. In the illustrated embodiment, each pair of notches 24 respectively take the right-angled isosceles triangular plane shape, and substantially confront each other in the transverse direction of both strips 12. In case each pair of notches 24 take the same shape and completely transversely confront each other as in the illustrated embodiment, or in case each pair of notches 24 take the same shape but are slightly displaced from their completely confronting positions in the longitudinal direction of both strips 12 to incompletely confront each other, or in case each pair of notches 24 differ from each other in shape (including the shapes similar to each other) and completely transversely confront each other, it may surely be said that both notches 24 substantially transversely confront each other. Also, each one pair of substantially and transversely confronting notches 24 are respectively placed at the opposite sides of each line l. Further, in the illustrated embodiment, one side other than the base of the imaginary right-angled isosceles triangle is parallel to each line l proximate to the corresponding notch 24.

With the arrangement of each pair of notches 24 as noted above, a pair of strip portions 26 or 28 are defined between one pair of confronting notches 24 in the transverse direction of both strips 12 and another pair of confronting notches 24 adjoining to the one pair of transversely confronting notches 24 in the longitudinal direction of both strips 12. A pair of confronting joint portions 18 in the longitudinal direction of each pair of strip portions 26 or 28 are placed at longitudinally opposite ends of each pair of strip portions 26 or 28. Each pair of longitudinally confronting joint portions 18 are placed at either one side of both strings 14 to be proximate to both longitudinally adjoining notches 24 at the one side, and besides, on a pair of adjoining lines l.

In order to form the artificial flower 16 by the ribbon 10 of the present invention, for example, a portion between a pair of transversely confronting notches 24 proximate to the other ends (left end in FIG. 1) of both strips 12 is held by fingers of one hand, while the other ends (left end in FIG. 1) of both strings 14 are held and pulled by fingers of the other hand to cause the relative movements of both strings 14 to both strips 12 in the longitudinal direction.

Figure 2:
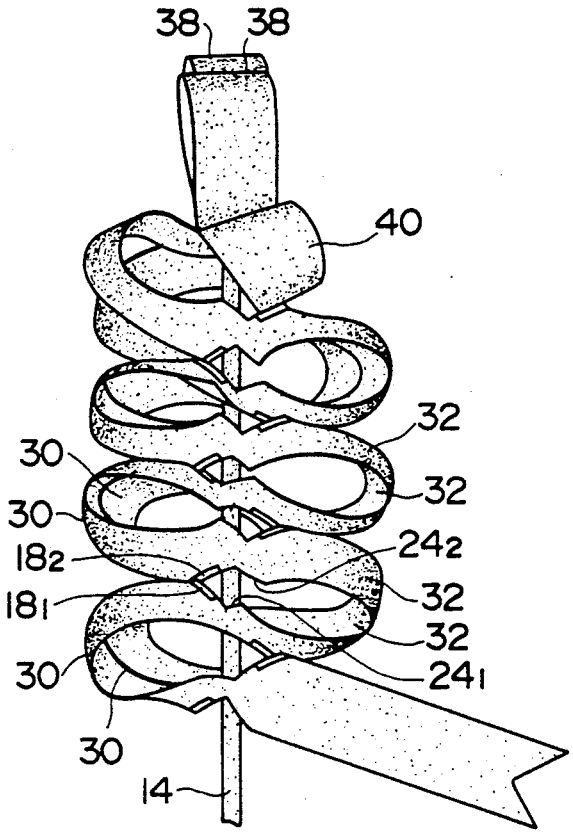
FIG. 2 is a perspective view showing the artificial-flower-forming ribbon of FIG. 1 during the formation of an artificial flower.
Figure 6:
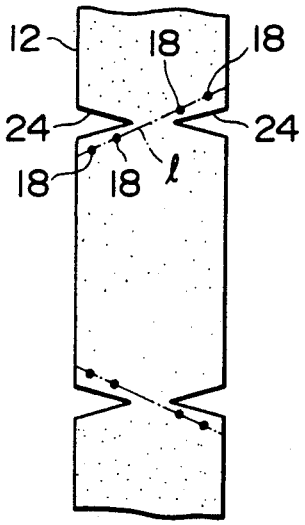
FIGS. 6 through 9 are fragmentary plan views showing artificial-flower-forming ribbons having notches different in shape from those of the ribbons shown in FIGS. 1 and 4, respectively.
Figure 7:
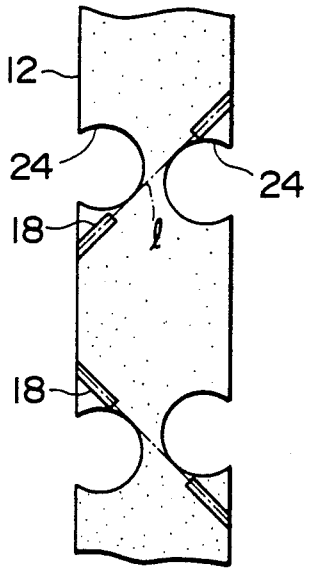

When both strings 14 are moved relative to both strips 12, each pair of strip portions 26 or 28 are respectively expanded and rounded out at the corresponding joint portions 18 during the relative movements of both strings 14 to both strips 12 to be deformed into a pair of loops 30 or 32 (See FIG. 2). In the illustrated embodiment, an angle defined by the extensions of a pair of adjoining lines l is set at 90°. Thus, each one pair of loops make an angle of 90° to each other to be open. The angle defined by the extensions of a pair of adjoining lines l may be set at will, for example, at angles as shown in FIGS. 6 and 7. Since the inclinations of a plurality of lines l are alternately reverse, the loop 30 defined by the strip portion 26 and the loop 32 defined by the strip portion 28 are positioned as being alternately reverse.

Here, in consideration of the upper half (a portion above the center line L or a portion at one side of both strings 14) of three pairs of strip portions 26, 28 and 26 successively placed on the left in FIG. 1, when a pair of left strip portions 26 are deformed into a pair of loops 30, one longitudinal ends of the upper half of a pair of left strip portions 26 define a notch $24_1$, in the neighborhood of a joint portion $18_1$ to take the edge-like shape as shown in FIG. 2, so that the one longitudinal ends of the upper half extend in the direction substantially normal to the string 14. Similarly, when a pair of right strip portions 26 are deformed into a pair of loops 30, one longitudinal ends of the upper half of a pair of right strip portions 26 also define a notch $24_2$ in the neighborhood of a joint portion $18_2$ to take the edge-like shape, so that the one longitudinal ends extend in the direction substantially normal to the string 14. On the other hand, when a pair of strip portions 28 between two pairs of left and right strip portions 26 are deformed into a pair of loops 32, the opposite two pairs of ends of the upper half of a pair of strip portions 28 respectively define the notches $24_1$ and $24_2$ without any joint portion 18, so that each pair of ends open at a large angle.

Figure 3:
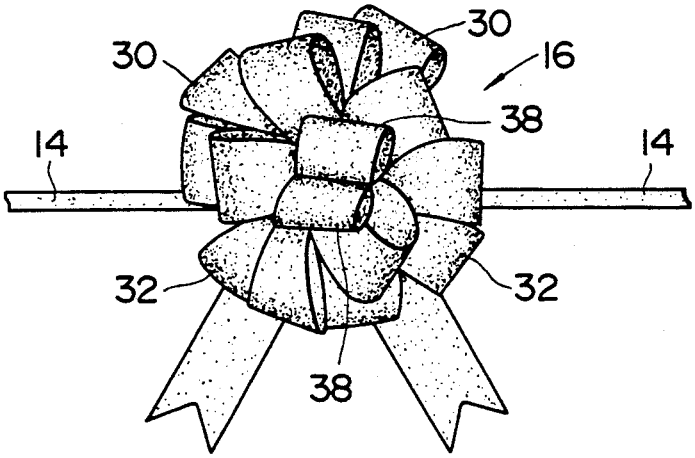
FIG. 3 is a plan view showing the artificial flower formed by the ribbon of FIG. 1.
Figure 5:
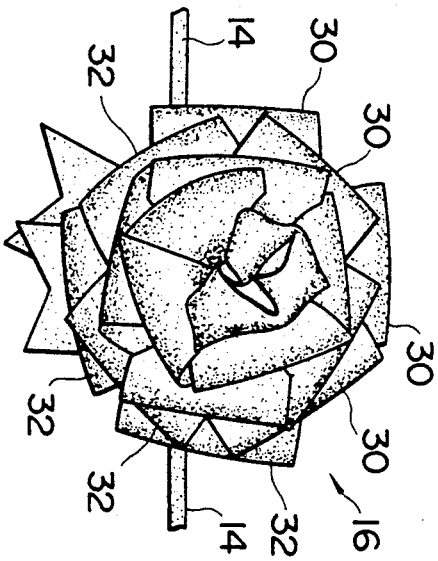
FIG. 5 is a plan view showing an artificial flower formed by the ribbon of FIG. 4.

As a result, the edge-like ends of two pairs of strip portions 26 in the neighborhood of the joint portion $18_1$ partially overlap each other to force two adjoining pairs of loops 30 in the extending direction of the string 14 to partially overlap each other or to partially confront each other. Accordingly, these two pairs of loops 30 are positioned such that one pair of loops 30 is partially visible through another pair of loops 30. It is the same with the lower half of three pairs of strip portions 28, 26 and 28 successively placed at the other side of both strings 14. As shown in FIGS. 3 and 5, with the relative movements of both strings 14 to both strips 12, the ribbon 10 results in the artificial flower which is formed such that each pair of loops 30 or 32 mutually fill up a gap between the other pair of loops.

As shown in FIG. 1, the distance between each pair of adjoining lines l, i.e., the mutual distance between intersections of each pair of lines l and the center line L is made equal or varies so as to successively lengthen from one ends toward the other ends of both strips 12, for example. Thus, various forms of artificial flowers are obtained depending on the size of the distance between each pair of lines l. FIG. 4 shows another embodiment of the ribbon, in which the distance between each pair of lines l varies so as to gradually lengthen from one ends toward the other ends of both strips 12. According to the ribbon of FIG. 4, the loops are arranged such that, the longer the loops are, the lower they are placed, so that the artificial flower 16 formed by the ribbon of FIG. 4 takes the rose-like shape as shown in FIG. 5.

Again returning to FIG. 1, with the relative movements of both strings 14 to both strips 12, a pair of strip portions 34 between the joint portions 20 located on the right end in the drawing and the joint portions 22 adjoining to these joint portions 20 are deformed into a pair of loops 38, while a pair of strip portions 36 between the joint portions 22 and the joint portions 18 adjoining to these joint portions 22 are also deformed into a pair of loops 40. These loops 38 and 40 extend parallel or substantially parallel to both strings 14 to form the center of the artificial flower 16. These joint portions 22 may be provided on a line which is not perpendicular to the center line L, if necessary.

As for the plane shape of the notch, not only the V-like shape, but also the circular-arc shape (See FIG. 7), the U-like shape (See FIG. 8) and the constricted shape (See FIG. 9) defined by a pair of intersecting circular arcs with the same curvature are available. Further, as shown in FIG. 6, the notch can take the V-like shape defining non right-angled isosceles triangle in plane. In any shape, it is preferable that the distance between a pair of transversely confronting notches is as small as possible. In case the distance between a pair of transversely confronting notches is made small, when the edge-like portions partially overlap each other, one of two pairs of loops including these edge-like portions are easily displaced toward the other loop pair around the longitudinal center line of both strings 14 together with the strings 14.

Figure 8:
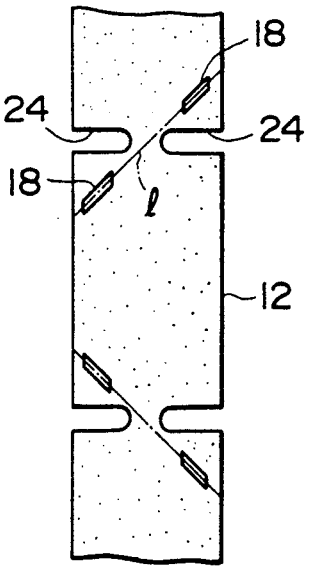
Figure 9:
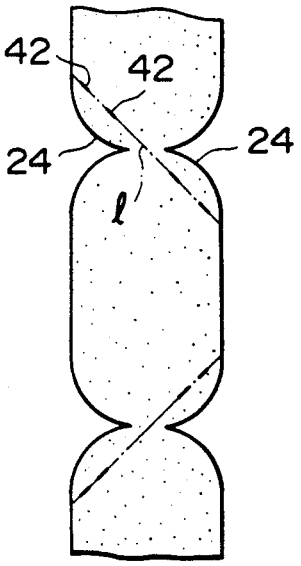

Further, as shown in FIGS. 1, 4 and 7, each joint portion 18 is formed of one elongated area coming to an end at each side edge of both strips 12, more particularly, a substantially rectangular area. Also, each joint portion 18 is formed of a plurality of dot-like areas (for instance, two) as shown in FIG. 6, or one elongated area not coming to an end at each side edge of both strips 12 as shown in FIGS. 8 and 9. Further, while each joint portion 18 defines each edge of the notch 24 in accordance with the embodiments shown in FIGS. 1 and 4, each joint portion 18 is placed to be slightly apart from each edge of the notch 24.

Both strips 12 are joined together according to various methods in consideration of a material of both strips 12. For example, in the case where both strips 12 are made of synthetic fiber or plastic tape, ultrasonic vibration, high-frequency wave or the like is applied to both strips 12 or a heating needle is thrusted into both strips 12 to thermally deposit or weld both strips 12 together. Also, both strips are bonded together with proper adhesives. Further, in case both strips 12 are made of fabric of natural fiber which is not suitable for joining both strips 12 by means of welding as noted above, both strips 12 are joined together by stitching with thread, or bonded together with a thermal bonding film including resin which is fusible by means of heating. FIGS. 1, 4, 7 and 8 show the embodiments, in which both strips 12 are welded together by making use of ultrasonic vibration, high-frequency wave or the like. Further, FIG. 6 shows the embodiment, in which both strips 12 are welded together by making use of a heating needle. FIG. 9 shows the embodiment, in which both strips 12 are joined together by stitching with thread 42.

Further, subscripts 1 and 2, such as $18_1$, $18_2$, $24_1$ and $24_2$, are respectively used only for discriminating between two joint portions 18 and two notches 24. Referring to FIG. 2, in order to facilitate understanding of the characteristics of the present invention, a pair of loops 30 and a pair of loops 32 are respectively drawn to be spaced apart from each other.

What is claimed is:

1. An artificial-flower-forming ribbon comprising:

a pair of strips overlapping to each other; and at least one string placed between and along said strips;

both said strips being joined together at a plurality of joint portions placed at opposite sides of said string and also on a plurality of lines spaced apart from each other in the longitudinal direction of said strips;

said string being joined at its one end to one ends of said strips; and a pair of adjoining lines being in parallel to two equilateral sides of an isosceles triangle where a segment parallel to a longitudinal center line of said strips is defined as the base;

wherein said both strips have a pair of notches provided at opposite sides of each line in the neighborhood of said joint portions to be respectively open to opposite side edges of said strips, and substantially confronting each other in the transverse direction of said strips whereby the ribbon loops formed on pulling of the string being such that upper and lower pairs of loops deviate one from the next rotationally about the string and are there maintainable without any tendency to untwist.

2. An artificial-flower-forming ribbon according to claim 1, wherein each of said pair of notches takes a V shaped shape.

3. An artificial-flower-forming ribbon according to claim 2, wherein one side of said V-like notch is parallel to said line proximate to said one side.

4. An artificial-flower-forming ribbon according to claim 1, wherein each of said pair of notches takes a circular-arc shape.

5. An artificial-flower-forming ribbon according to claim 1, wherein each joint portion of said strips has an elongated plane shape.

6. An artificial-flower-forming ribbon according to claim 5, wherein said each joint portion comes to an end at each side edge of said strips.

7. An artificial-flower-forming ribbon according to claim 1, wherein said each joint portion takes a dot shape.

8. An artificial-flower-forming ribbon according to claim 1, wherein both said strips are joined together by means of thermal welding.

9. An artificial-flower-forming ribbon according to claim 1, wherein both said strips are joined together by means of thermal adhesion.

10. An artificial-flower-forming ribbon according to claim 1, wherein both said strips are joined together by means of stitching with thread.

11. An artificial-flower-forming ribbon according to claim 1, wherein the mutual distances between each pair of lines are made equal.

12. An artificial-flower-forming ribbon according to claim 1, wherein the mutual distance between each pair of lines varies so as to gradually lengthen from one ends toward the other ends of said strips.

* * * * *